United States Patent [19]

Leboutet

[11] 4,425,529

[45] Jan. 10, 1984

[54] CHARGED-PARTICLE ACCELERATING DEVICE FOR METRIC WAVE OPERATION

[75] Inventor: Hubert Leboutet, St. Cloud, France

[73] Assignee: C.G.R. MeV, Buc, France

[21] Appl. No.: 240,236

[22] Filed: Mar. 3, 1981

[30] Foreign Application Priority Data

Mar. 4, 1980 [FR] France ..... 80 04835

[51] Int. Cl.[3] ..... H01J 25/10

[52] U.S. Cl. ..... 315/5.41; 376/108

[58] Field of Search ..... 315/5.41, 5.42; 328/233; 313/359.1; 250/423 R; 376/108

[56] References Cited

U.S. PATENT DOCUMENTS

| | | | |
|---|---|---|---|
| 2,163,740 | 6/1939 | Wales, Jr. | 315/5.42 |
| 3,172,008 | 3/1965 | Schmidt et al. | 315/5.41 |
| 3,887,832 | 6/1975 | Drummond et al. | 315/5.41 |
| 3,906,300 | 9/1975 | Tran | 315/5.41 |
| 4,140,942 | 2/1979 | Auslender et al. | 315/5.42 |
| 4,162,423 | 7/1979 | Tran | 315/5.42 |

*Primary Examiner*—Sal Cangialosi

*Attorney, Agent, or Firm*—Cushman, Darby & Cushman

[57] ABSTRACT

The particle-accelerating device comprises a charged-particle source, a linear accelerating structure formed by a series of accelerating resonant cavities, an electromagnetic wave generator for emitting a signal to be injected into at least one of the resonant cavities. Means are provided for applying a pulsed high voltage to the particle source and for scanning a target with the pulsed beam of accelerated particles. The electromagnetic wave generator comprises a thermionic tube having a cathode, an anode and at least one grid. At least one of the resonant cavities is electromagnetically coupled to the grid-anode space of the tube.

9 Claims, 5 Drawing Figures

CHARGED-PARTICLE ACCELERATING DEVICE FOR METRIC WAVE OPERATION

Irradiation equipment employed in industry and more especially irradiators employed for sterilization of food products or pharmaceutical products entail the need to form beams of charged particles such as electrons, for example, having energies within the range of 1 to 10 MeV and mean power outputs of a few tens of kilowatts. In fact, the value of 10 MeV is laid down as a limit for the energy of electrons in order to forestall any potential danger of formation of radioactive products in the irradiated elements.

Irradiators can make use of accelerators of the Van de Graff type or of the Grenacher column type which make it possible to attain high mean power outputs but are usually limited to energies within the range of 2 to 3 MeV by reason of the difficulties arising from the need to provide insulating materials having sufficient dielectric strength.

In irradiation devices of this type, it is also a known practice to employ linear accelerators which operate at frequencies in the vicinity of 3000 MHz, the microwave generator associated with these accelerators being usually a magnetron or a klystron which operates with pulses of short duration.

However, it may prove advantageous in some applications (such as the treatment of water and sludges, for example) to employ irradiation devices of simple design and low cost.

The aim of the present invention is to provide a charged-particle accelerating device which operates with metric waves and can advantageously be employed in irradiation devices of the type mentioned in the foregoing.

In accordance with the invention, a charged-particle accelerating device comprises a particle source, a linear accelerating structure formed by a series of accelerating resonant cavities, an electromagnetic wave generator capable of emitting a signal to be injected into at least one of said resonant cavities, means for applying a pulsed high voltage to the particle source, means for focusing the beam and means for scanning a target with the beam of accelerated particles. The device is distinguished by the fact that the electromagnetic-wave generator comprises a thermionic tube provided with a cathode, an anode and at least one grid, and that at least one of the resonant cavities of the accelerating structure is electromagnetically coupled to the grid-anode space of the tube.

Other features of the invention will be more apparent to those skilled in the art upon consideration of the following description and accompanying drawings, wherein.

Figure 1:
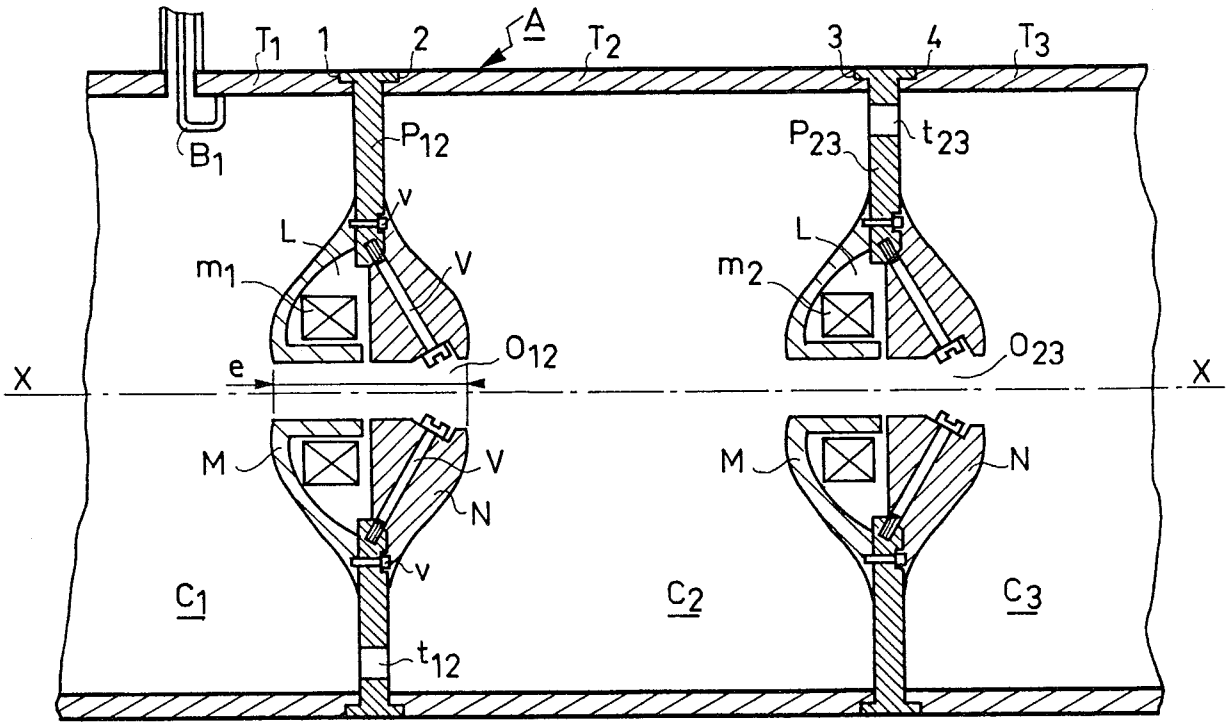
FIG. 1 illustrates one exemplified embodiment of a linear accelerating structure designed for metricwave operation in accordance with the invention.

FIG. 1 shows one exemplified embodiment of a linear accelerating structure $S_A$ in accordance with the invention. This structure $S_A$ is of the biperiodic type designed for metric-wave operation and comprises a series of cylindrical accelerating cavities $C_1$, $C_2$, $C_3$ . . . , two successive accelerating cavities $C_1$, $C_2$ or $C_2$, $C_3$ . . . being electromagnetically coupled to each other by means of coupling holes $t_{12}$, $t_{23}$ . . . respectively.

In one example of construction, the accelerating structure $S_A$ in accordance with the invention is constituted by a succession of cylindrical metal tubes $T_1$, $T_2$, $T_3$ . . . having an axis X—X and formed of copper, for example. Said tubes are placed in abutting relation and provided at their extremities with centering shouldered portions 1, 2 and 3, 4 . . . in order to permit ready assembly of the structure $S_A$. Circular metal plates $P_{12}$, $P_{23}$ . . . are placed between two successive tubes $T_1$, $T_2$ or $T_2$, $T_3$ . . . and define the accelerating cavities $C_1$, $C_2$, $C_3$ . . . in the longitudinal direction. Elements M and N are fixed on each of the plates $P_{12}$, $P_{23}$ . . . which are provided with a central orifice $O_{12}$, $O_{23}$ . . . respectively. Said elements M and N are of increasing thickness from their peripheral zone to their central zone and define within the central zone of the accelerating structure a drift space e between two consecutive resonant cavities $C_1$, $C_2$ or $C_2$, $C_3$ . . . of the accelerating structure $S_A$ of the biperiodic type.

As shown in FIG. 1, the shape of the element M is such as to constitute an annular housing L on the face located opposite to the plate $P_{12}$ or $P_{23}$ on which said element is fixed, a magnetic coil $m_1$ or $m_2$ . . . for focusing the charged particle beam being placed within said housing. A radial channel (not shown in the figure) which is formed in the plate $P_{12}$, $P_{23}$ provides a passage for the incoming leads to the coils $m_1$, $m_2$.

In the example of construction of the accelerating structure $S_A$ shown in FIG. 1, the element M is fixed on the plate $P_{12}$ by means of a series of screws v, the head of each screw being embedded in said plate $P_{12}$. The element N is fixed on the plate $P_{12}$ opposite to the element M by means of a series of screws V which are placed obliquely with respect to the plate $P_{12}$.

This example of construction of a linear accelerating structure $S_A$ is not given in any limiting sense. It would also be possible to employ a triperiodic linear structure or an interdigital structure of known type (these alternative structures having been omitted from the drawings).

Irrespective of the type of accelerating structure which is chosen, at least one of the accelerating cavities of the accelerating structure is coupled electromagnetically to an electromagnetic wave generator which, in one example of construction of the accelerating device in accordance with the invention, is an oscillating triode which operates with metric waves.

Figure 2:
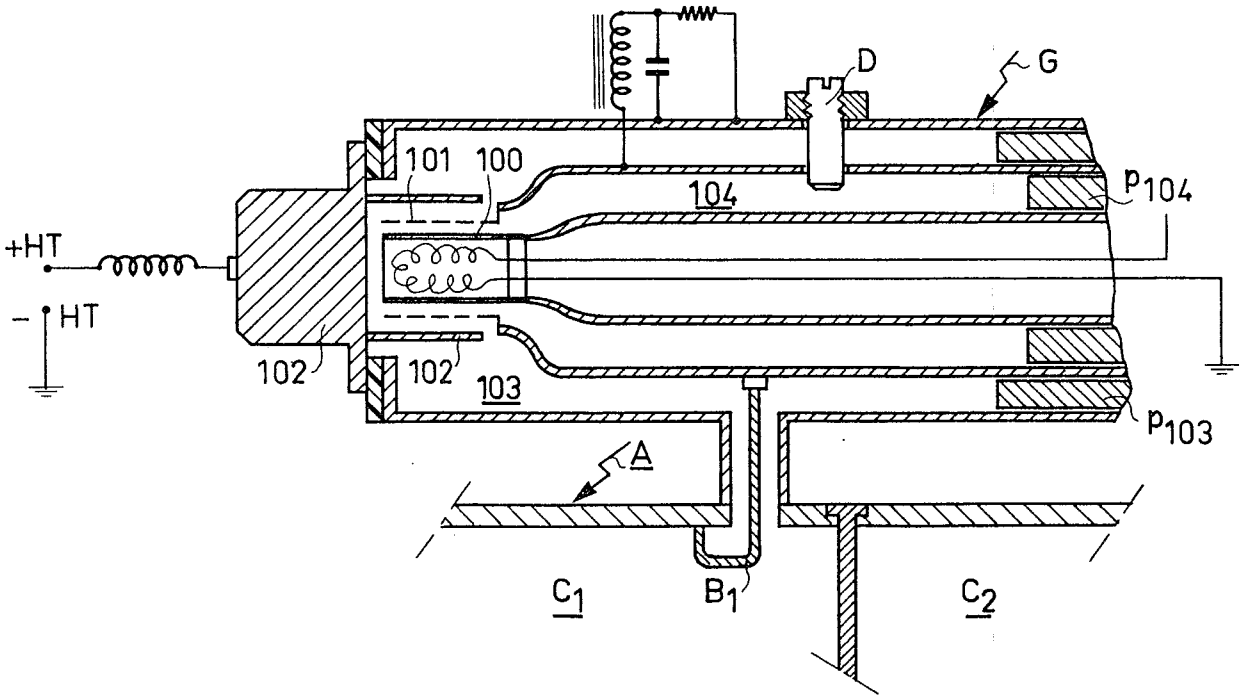
FIGS. 2 and 3 illustrate respectively two examples of electromagnetic coupling of an oscillating triode with the accelerating structure shown in FIG. 1.

FIG. 2 shows a system for electromagnetic coupling of said triode G and of the accelerating structure $S_A$ in accordance with the invention, as shown in FIG. 1.

Said triode G of conventional type comprises a cathode 100, a grid 101 and an anode 102. The grid-anode space 101–102 is associated with a coaxial line 103 which is electromagnetically coupled to the accelerating cavity $C_1$ of the accelerating structure $S_A$ by means of a coupling loop $B_1$ which extends downwards into said cavity $C_1$. In this example of construction, the cathode-grid space 100–101 is associated with a coaxial line 104 and this latter is capacitively coupled to the coaxial line 103 by means of a radial plunger D. The depth of penetration of said plunger in the coaxial line 104 is adjustable. Movable annular pistons $p_{103}$, $p_{104}$ without electric contacts and placed respectively in the coaxial lines 103 and 104 serve to adjust the length of said coaxial lines 103 and 104 in a suitable manner.

During operation, the triode G oscillates in the $\pi$ mode at the resonance frequency f of the cavities $C_1$, $C_2$ . . . .

Figure 3:
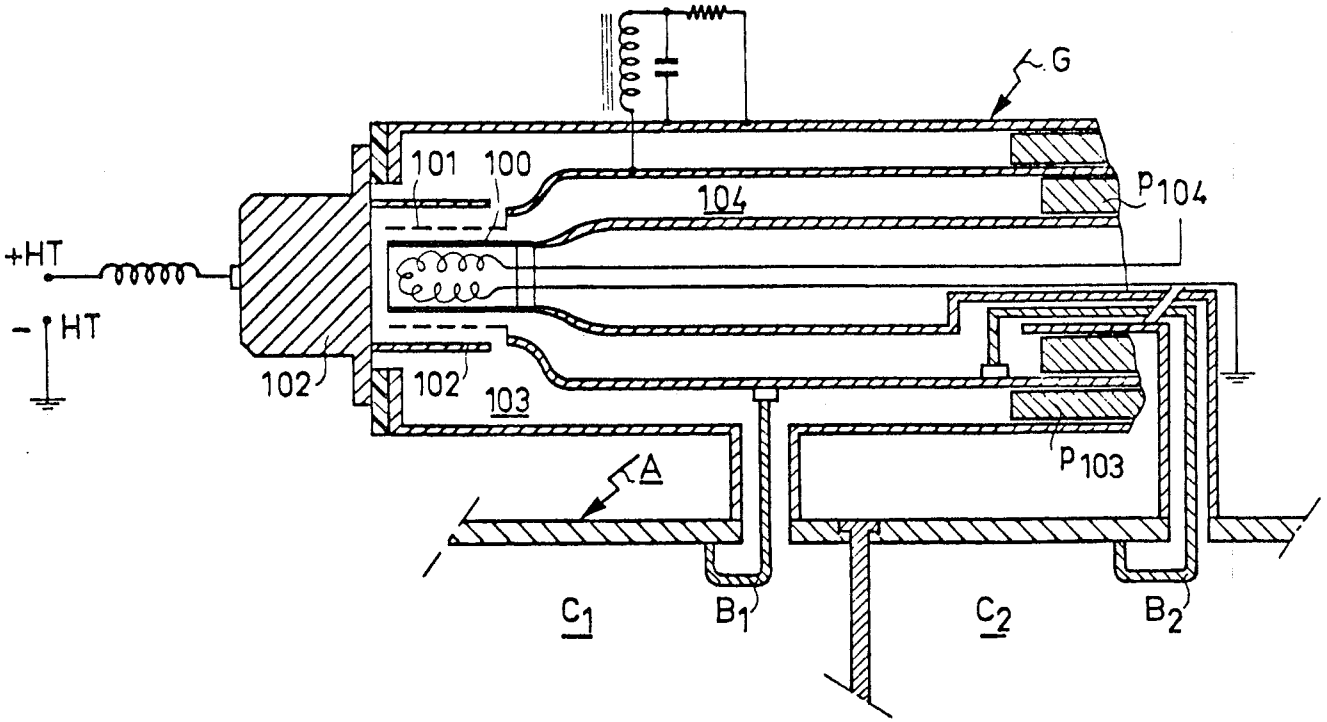

In another example of construction of the accelerating device in accordance with the invention and as shown in FIG. 3, the coaxial line 103 associated with the cathode-grid space 100–101 is electromagnetically coupled to the cavity $C_2$ of the accelerating structure A by means of a coupling loop $B_2$ which extends downwards into said cavity $C_2$. A coupling of this type makes it possible to generate an alternating-current voltage having a frequency f between the grid 101 and the cathode 100 of the triode G so as to ensure that said cathode-grid space 100–101 is excited in phase opposition with respect to the grid-anode space 101–102 of the triode G.

It is worthy of note that the triode G can be replaced by a conventional oscillating tetrode (not shown in the drawings).

In another example of construction of the accelerating device in accordance with the invention, it is also possible to replace the oscillating triode G by an amplifying triode associated with a control oscillator (not shown).

In certain applications mentioned in the foregoing, the accelerating device in accordance with the invention is designed for pulsed operation with a long pulse duration of the order of one millisecond. This pulse length is essentially dictated by the operating frequency f of the accelerating structure (200 MHz, for example), the time required for filling the cavities of the accelerating structure with electromagnetic energy being proportional to $\lambda^{3/2}$, where $\lambda$ is the wavelength corresponding to the frequency f.

Figure 4:
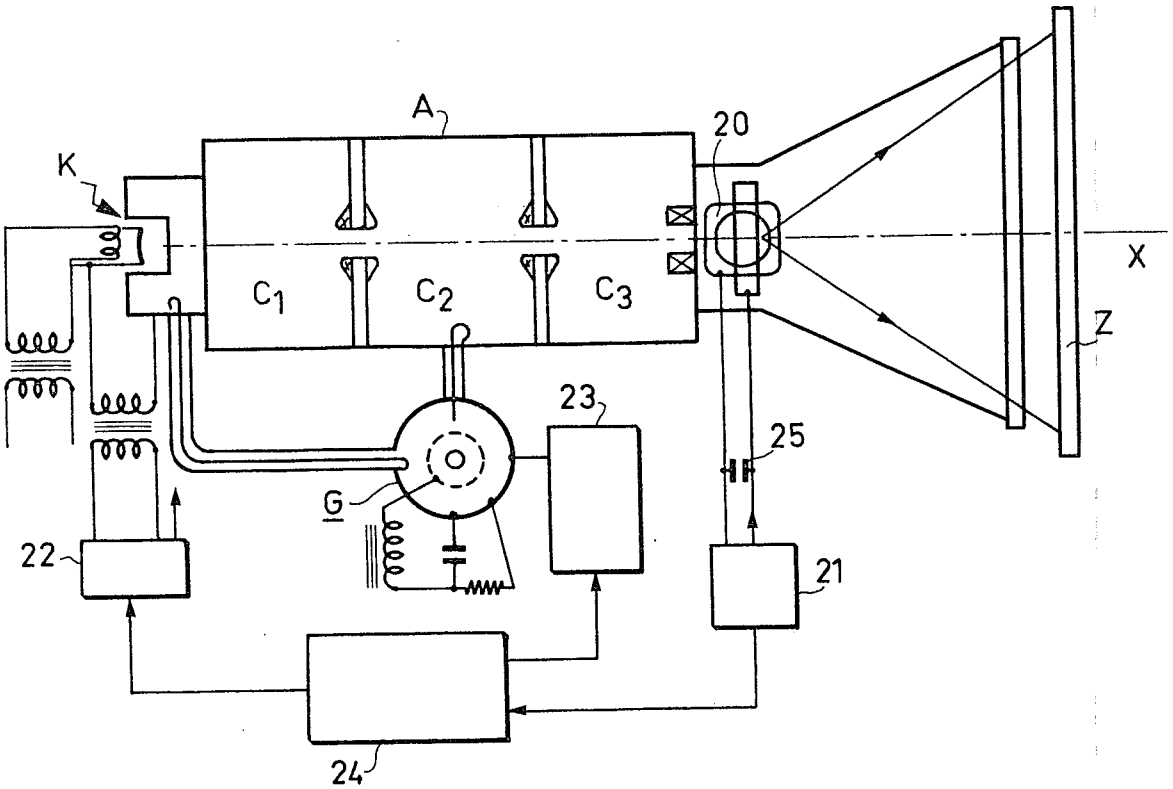
FIG. 4 illustrates a linear accelerator in accordance with the invention and associated with a device for scanning the accelerated particle beam and the means for feeding the accelerator unit and a scanning device as well as the oscillating triode associated with the accelerator.

FIG. 4 shows diagrammatically a system for supplying voltage to an accelerating device in accordance with the invention in which the scanning beam delivered is intended to scan a large-width target Z. The linear accelerator A is supplied with a pulsed high-voltage delivered, for example, by a modulator 22 having delay lines associated with thyristors. These delay lines placed in parallel are loaded in known manner by a rectifier connected to the general supply mains. This supply system comprises in addition:

a generator 21 which operates at a frequency of 300 Hz, for example, and serves to excite a scanning electromagnet 20 with a sine-wave current;

a capacitor 25 for frequency tuning of the generator 21;

a modulator 23 for supplying high-voltage to the triode G;

a device 24 for triggering the pulses of the modulators 22 and 23 and permitting synchronization of the pulses transmitted by the modulator 22 to the cathode K of the accelerator and by the modulator 23 to the anode 102 of the triode G.

During operation, the generator 21 which supplies the electromagnet 20 controls the device 24 for triggering the pulses of the one hand of the modulator 23 of the triode G and then, on the other hand, of the modulator 22 of the cathode K of the accelerator A. The generator 21 delivers a sinusoidal voltage having a period in the vicinity of 300 Hz, for example. Triggering of the pulses applied respectively to the cathode K of the accelerator A and to the triode G is such that said pulses (having a duration of one millisecond, for example) pass during the time interval $\Delta t$ corresponding to the time of scanning of the target Z whilst the potential $V_{21}$ applied to the electromagnet varies during this time interval $\Delta t$ between the values $v_M$ and $v_m$. This is obtained with a triggering frequency equal to a submultiple of 300. The repetition frequencies can be 10, 30 or 50 Hz, for example.

Figure 5:
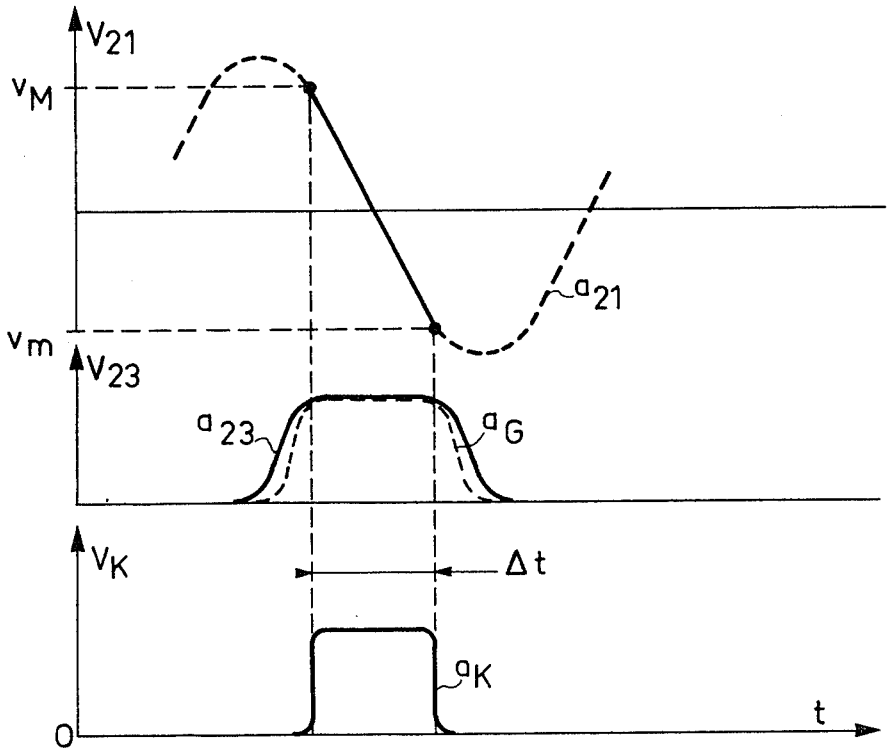
FIG. 5 illustrates the signals $a_{21}$, $a_G$, $a_K$ applied respectively to the scanning electromagnet, to the triode and to the cathode of the particle accelerator during a time interval $\Delta t$.

FIG. 5 shows the signal $a_{21}$ applied to the electromagnet 21, the signal $a_{23}$ delivered by the modulator 23 as well as the signal $a_G$ applied to the anode 102 of the triode G, and finally the signal $a_K$ applied to the cathode K of the accelerator A.

A supply system of this type therefore permits scanning of the total width of the target Z by the accelerated-particle beam during the period $\Delta t$ of the pulse applied to the cathode K of the accelerator A. The recurrence frequency of these pulses corresponds to k times the period of the sine-wave signal $a_{21}$ applied to the electromagnet 21, where k is a whole number equal to or higher than 1.

What is claimed is:

1. A charged-particle accelerating device for metric wave-length operation comprising a source of charged particles, a linear accelerator having a series of resonant cavities for accelerating a beam of said charged particles and means in said cavities for focusing said beam, an electromagnetic wave generator for emitting a signal and injecting said signal into a least one of said resonant cavities, means for applying a pulsed high voltage to the particle source to produce said particles, and means for scanning a target with the beam of accelerated particles, wherein the electromagnetic wave generator comprises a thermionic tube provided with a cathode, an anode and at least one grid, at least one of the resonant cavities of the accelerating structure being electromagnetically coupled to the grid-anode space of the tube.

2. A particle-accelerating device according to claim 1, wherein the tube is an oscillating triode G.

3. A particle-accelerating device according to claim 1, wherein the tube is an oscillating tetrode.

4. A particle-accelerating device according to claim 1, wherein the generator is an amplifying tube associated with a control oscillator having a frequency f equal to the resonance frequency of the resonant cavities of the accelerating structure.

5. A particle-accelerating device according to claim 2, wherein the triode G which comprises a coaxial line of adjustable length associated with the grid-anode space and a coaxial line of adjustable length associated with the cathode-grid space is electromagnetically coupled to one of the resonant cavities of the accelerating structure by means of a loop and wherein a movable plunger provides a capacitive coupling between the coaxial lines.

6. A particle-accelerating device according to claim 2, wherein the triode G which comprises a coaxial line of adjustable length associated with the grid-anode space and a coaxial line associated with the cathode-grid space is provided with coupling means on the one hand for electromagnetically coupling the coaxial line to a first cavity of the accelerating structure and on the other hand for electromagnetically coupling the coaxial line to a second cavity of said accelerating structure which immediately follows the first cavity so as to ensure that the cathode-grid space of the triode is excited in phase opposition with respect to the grid-anode space, the accelerating structure being of the biperiodic type.

7. A particle-accelerating device according to claim 1, wherein the system for scanning the accelerated-particle beam serves to scan the width of a target Z at each pulse of said accelerated-particle beam.

8. A particle-accelerating device according to claim 7, wherein said device comprises:

a modulator for applying a pulsed high voltage to the cathode of the accelerator;

a modulator for applying a pulsed high voltage to the anode of the triode;

a generator for delivering a sinusoidal voltage which is intended to be applied to a scanning electromagnet;

a device for triggering the pulses of the modulators, the function of the generator aforesaid being to control the initial operation of the device.

9. A device according to claim 1 and comprising a linear accelerating structure formed by a series of metal tubes of cylindrical shape having an axis X—X and by circular plates placed at right angles to said axis X—X, wherein annular elements are fixed respectively on each side of each plate aforesaid and wherein said elements are of increasing thickness from the peripheral zone to the central zone thereof, and wherein the shape of said annular elements is such as to form an annular housing on the face located opposite to each plate with which each element is associated, said annular housing being intended to accommodate a magnetic coil.

* * * * *